US008016398B2

(12) United States Patent
Kumagai

(10) Patent No.: US 8,016,398 B2
(45) Date of Patent: Sep. 13, 2011

(54) LIQUID EJECTION APPARATUS AND METHOD FOR SUPPLYING LIQUID IN LIQUID EJECTION APPARATUS

(75) Inventor: Toshio Kumagai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 254 days.

(21) Appl. No.: 12/406,204

(22) Filed: Mar. 18, 2009

(65) Prior Publication Data

US 2009/0179932 A1 Jul. 16, 2009

Related U.S. Application Data

(63) Continuation of application No. 11/390,221, filed on Mar. 28, 2006, now Pat. No. 7,524,044.

(30) Foreign Application Priority Data

Mar. 28, 2005 (JP) ..... 2005-092903

(51) Int. Cl.
*B41J 2/175* (2006.01)

(52) U.S. Cl. ..... 347/85

(58) Field of Classification Search ..... 347/49, 347/84, 85, 86, 87
See application file for complete search history.

(56) References Cited

U.S. PATENT DOCUMENTS

| | | | | |
|---|---|---|---|---|
| 4,432,005 | A | 2/1984 | Duffield et al. | |
| 4,737,301 | A | 4/1988 | Bloch et al. | |
| 6,030,074 | A | 2/2000 | Barniaga | |
| 6,267,474 | B1 | 7/2001 | Mochizuki | |
| 6,315,402 | B1 | 11/2001 | Kawase | |
| 6,478,415 | B2 | 11/2002 | Barinaga et al. | |
| 6,663,233 | B2 | 12/2003 | Otsuka et al. | |
| 6,773,099 | B2 | 8/2004 | Inoue et al. | |
| 6,843,557 | B2 | 1/2005 | Matsumoto | |
| 7,524,044 | B2 * | 4/2009 | Kumagai | 347/85 |

FOREIGN PATENT DOCUMENTS

| | | | |
|---|---|---|---|
| JP | 5-208492 | A | 8/1993 |
| JP | 6-27145 | U | 4/1994 |
| JP | 2002-240310 | A | 8/2002 |
| JP | 2002-370374 | A | 12/2002 |
| JP | 2002-370376 | A | 12/2002 |
| JP | 2003-220711 | A | 8/2003 |
| JP | 2003-237104 | A | 8/2003 |
| JP | 2004-202797 | A | 7/2004 |

* cited by examiner

*Primary Examiner* — Anh T. N. Vo

(74) *Attorney, Agent, or Firm* — Sughrue Mion, PLLC

(57) ABSTRACT

A printer has a carriage on which a recording head and pumps are mounted. An air supply device and ink cartridges are provided in a frame of the printer. The pumps are connected to the air supply device with an air supply tube. Each pump is connected to corresponding one of the ink cartridges with an ink supply tube. Based on actuation of a drive mechanism of the air supply device, air is supplied from the air supply device to the pumps. Based on changes in the pressure of the air, each pump draws ink from the corresponding ink cartridge and supplies the ink to the recording head. This permits the carriage to reciprocate in a reliable manner.

13 Claims, 6 Drawing Sheets

LIQUID EJECTION APPARATUS AND METHOD FOR SUPPLYING LIQUID IN LIQUID EJECTION APPARATUS

CROSS-REFERENCE TO RELATED APPLICATIONS

The present application is a Continuation of U.S. application Ser. No. 11/390,221, filed in the U.S. Patent and Trademark Office on Mar. 28, 2006, which claims priority from Japanese Patent Application No. 2005-092903, filed in the Japanese Patent Office on Mar. 28, 2005. The entire disclosures of the prior applications are hereby incorporated by reference.

BACKGROUND OF THE INVENTION

The present invention relates to a liquid ejection apparatus and a method for supplying liquid in a liquid ejection apparatus.

Inkjet printers (hereinafter referred to as printers) are widely known as liquid ejecting apparatuses for ejecting liquid onto a target. Such a printer has a reciprocating carriage on which a recording head (liquid ejection head) is mounted. The printer ejects ink (liquid) supplied to the recording head from nozzles, thus performing printing on a recording medium serving as a target.

Among such printers, a printer used for performing a large amount of printing has an ink cartridge (liquid container) of a large capacity on the printer main body. Ink is supplied to a recording head through an ink supply tube by means of pressure generated by a pressure pump. However, in this configuration, if a minute hole is formed in the ink supply tube, pressurized ink leaks to the outside from the ink supply tube. To avoid such possibility of oil leakage, printers such as the one disclosed in Japanese Laid-Open Patent Publication No. 2003-220711 have been proposed.

The printer disclosed in Japanese Laid-Open Patent Publication No. 2003-220711 has an ink supply pump mounted on a reciprocating carriage. The ink supply pump includes a cylindrical member and a movable member. The cylindrical member has an axis extending along the moving direction of the carriage, and the movable member slides in the cylindrical member. An ink inlet is provided at one end of the cylindrical member to introduce ink from an ink cartridge, and an ink outlet is provided at the other end to discharge the ink to the recording head. A one-way valve is provided in the movable member to permit ink to flow only in a direction from the ink inlet toward the ink outlet. When the reciprocating carriage accelerates or decelerates, the movable member moves in the cylindrical member relative to the carriage. Accordingly, ink that is introduced into the cylindrical member from the ink cartridge through the ink inlet passes through the one-way valve, and is then discharged to the recording head through the ink outlet.

However, the cylindrical member, which is moved by inertia relative to the carriage as the carriage reciprocates, increases weight of the entire carriage, thus increases vibration generated when the carriage is moved. The cylindrical member also increases power consumption required for causing the carriage to reciprocate.

SUMMARY

Accordingly, it is an objective of the present invention to provide a liquid ejection apparatus and a method for supplying liquid in a liquid ejection apparatus that reliably permit a carriage to reciprocate while preventing leakage of liquid from a liquid supply line.

To achieve the foregoing objective, according to one aspect of the present invention, a liquid ejection apparatus includes an apparatus main body, a carriage that is capable of reciprocating relative to the apparatus main body, a liquid ejection head mounted on the carriage, a pump mounted on the carriage, a working fluid supply source, a liquid supply source, a working fluid supply line, and a liquid supply line. The working fluid supply source is provided in the apparatus main body, and has a drive mechanism. The liquid supply source is provided in the apparatus main body, and contains liquid. The working fluid supply line connects the pump to the working fluid supply source. Based on actuation of the drive mechanism, the working fluid is supplied to the pump from the working fluid supply source through the working fluid supply line. The liquid supply line connects the pump to the liquid supply source. Based on a change in a pressure of the working fluid, the pump draws liquid from the liquid supply source through the liquid supply line, and supplies the liquid to the liquid ejection head.

Another aspect of the present invention is a method for ejecting liquid in a liquid ejection apparatus. The apparatus includes a carriage capable of reciprocating relative to an apparatus main body, a liquid ejection head mounted on the carriage, a pump mounted on the carriage, and a liquid supply source provided in the apparatus main body. The method includes: providing the apparatus main body with a working fluid supply source having a drive mechanism; supplying working fluid from the working fluid supply source to the pump through a working fluid supply line based on actuation of the drive mechanism; and causing the pump to perform pumping action based on a change in a pressure of the working fluid, thereby drawing liquid from the liquid supply source to the pump through a liquid supply line and supplying the liquid form the pump to the liquid ejection head.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 3.

Figure 1:
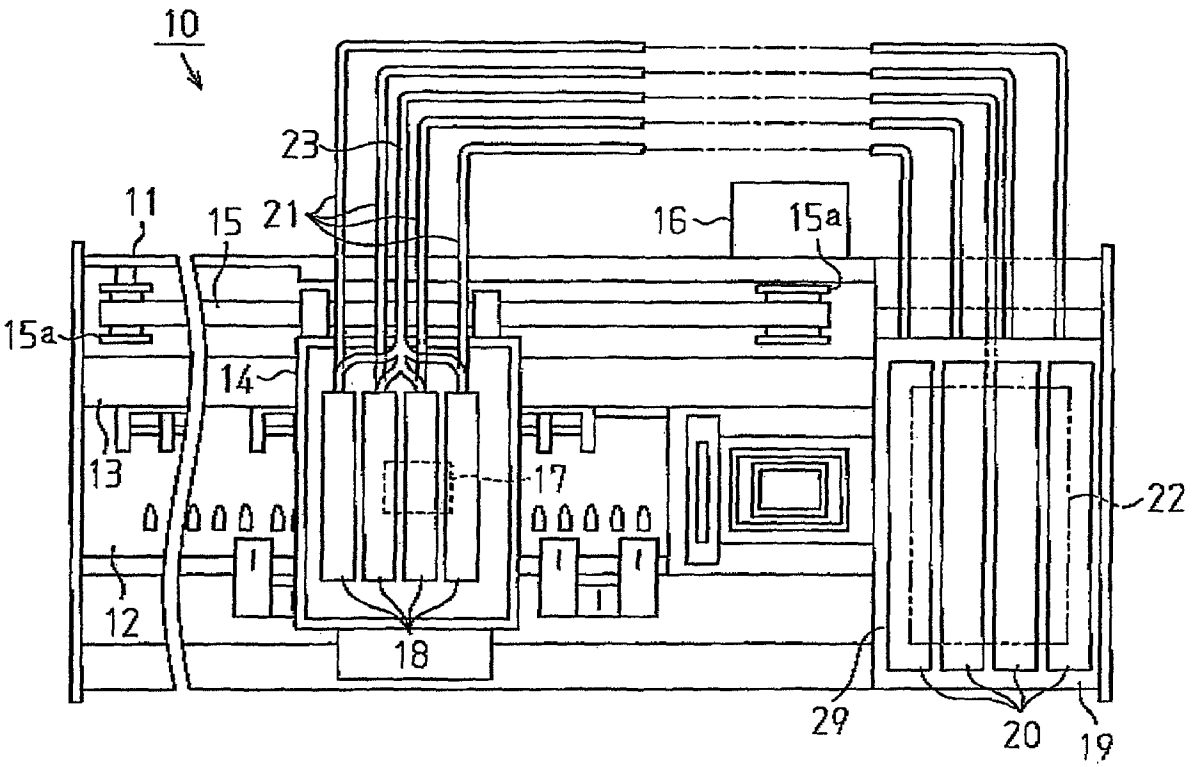
FIG. 1 is a diagrammatic plan view illustrating printer according to a first embodiment of the present invention.

As shown in FIG. 1, an inkjet printer 10 (hereinafter referred to as a printer), which functions as a liquid ejection apparatus, has a frame (apparatus main body) 11. The frame 11 has a rectangular shape as viewed from above. A platen 12 is supported by the frame 11. A paper feed mechanism having a paper feed motor (not shown) feeds sheets of recording paper along the platen 12.

A rod-like guide member 13 is supported also by the frame 11 and extends parallel with the longitudinal direction of the platen 12. A carriage 14 is supported by the guide member 13, which is passed through the carriage 14, so that the carriage 14 reciprocates on the guide member 13. The carriage 14 is connected to a carriage motor 16 through a timing belt 15 that is wound around a pair of pulleys 15*a*. Thus, when the carriage motor 16 runs, the carriage 14 reciprocates along the guide member 13.

A recording head (liquid ejection head) 17 is located on a lower side of the carriage 14. A plurality of ejection nozzles (not shown) are located on a surface of the recording head 17 that faces the platen 12. The ejection nozzles eject ink (liquid) toward a recording paper sheet supplied onto the platen 12. Pumps 18 are mounted on the upper surface of the carriage 14. The pumps 18 are activated when ink is supplied to the recording head 17. The number of the pumps 18 corresponds to the number of colors of the ink used in the printer 10. In this embodiment, the number of colors is four.

As shown in FIG. 1, a cartridge holder 19 is arranged at one end (the right end as viewed in FIG. 1) of the frame 11. A plurality of (in the illustrated embodiment, four) ink cartridges 20 (liquid supply source) each containing ink of a different color are detachably attached to the cartridge holder 19. In this embodiment, inks of four colors, or black, yellow, cyan, magenta, are each contained in one of the ink cartridges 20. Each ink cartridge 20 is connected to the corresponding one of the pumps 18 with an ink supply tube (liquid supply line) 21.

An air supply device (working fluid supply source) 22 is arranged at one end (the right end as viewed in FIG. 1) of the frame 11 and below the cartridge holder 19. The air supply device 22 pressurizes air, which is a working fluid necessary for driving the pumps 18, and supplies the pressurized air to the pumps 18. The air supply device 22 also depressurizes and recovers the air from the pumps 18. An air supply tube (working fluid supply line) 23 extends from the air supply device 22. The distal end of the air supply tube 23 is branched into sections that each correspond to and are connected to one of the pumps 18.

Figure 2:
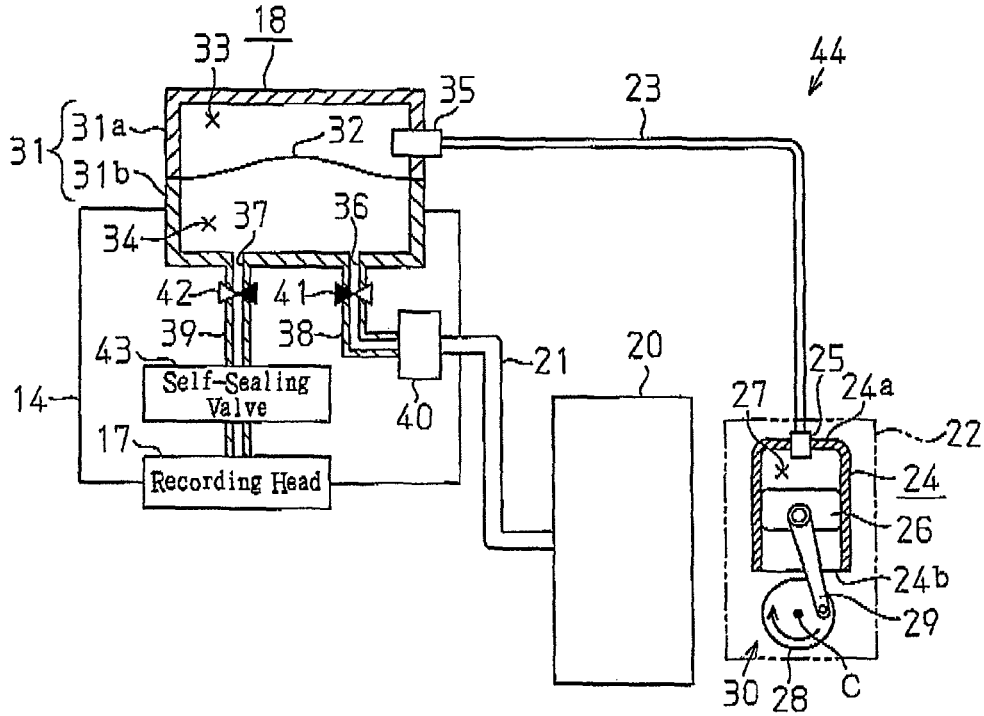
FIG. 2 is a schematic view showing a liquid supply system in the printer of FIG. 1.

As shown in FIG. 2, the air supply device 22 has a cylinder 24 having an end wall 24*a* at one end. A cylindrical connection member 25 fitted in the end wall 24*a*. A piston 26 is slidably accommodated in the cylinder 24. An air chamber (fluid chamber) 27 is defined between the piston 26 and an inner surface of the cylinder 24. The volume of the air chamber 27 varies in accordance with motion of the piston 26. A drum 28 is located at a position corresponding to an opening 24*b* of the cylinder 24. The drum 28 is rotated about an axis C that extends in a direction perpendicular to the movement axis of the piston 26 (a direction perpendicular to the sheet of FIG. 2) based on the driving force of a drive source (not shown). A coupler link 29 connects a portion of the drum 28 that is offset from the rotation center (the axis C) and the piston 26. The coupler link 29 converts rotation of the drum 28 into linear reciprocation of the piston 26.

FIG. 2 illustrates a state in which the piston 26 is in a middle position between the top dead center position and the bottom dead center position in the cylinder 24. When the drum 28 rotates from the state of FIG. 2 in a direction indicated by the arrow in FIG. 2, the piston 26 repeats a motion cycle in which it moves along the middle position, the bottom dead center position, the middle position, the top dead center, and the middle position in this order. That is, when the piston 26 moves toward the top dead center position, the air in the air chamber 27 flows out of the cylinder 24 through the connection member 25. On the other hand, when the piston 26 moves toward the bottom dead center position, air flows into the air chamber 27 through the connection member 25. In this embodiment, the piston 26, the drum 28, and the coupler link 29 form a drive mechanism 30 that changes the volume of the air chamber 27 in the cylinder 24, thereby generating driving force necessary for driving each pump 18.

As shown in FIG. 2, each of the pumps 18 mounted on the upper side of the carriage 14 has a substantially box-like pump case 31. Each pump case 31 includes an upper case 31*a* having an opening at the bottom and a lower case 31*b* having an opening at the top, which are connected such that the openings face each other. A diaphragm 32 is located between the upper case 31*a* and the lower case 31*b* to separate the interior of the pump case 31 into an upper chamber and a lower chamber. That is, in the pump case 31, the diaphragm 32 and the upper case 31*a* define an air introducing chamber (fluid introducing chamber) 33, and the diaphragm 32 and the lower case 31*b* define an ink introducing chamber (liquid introducing chamber) 34.

A cylindrical connection member 35 is fitted in a side wall of the upper case 31*a* of the pump case 31. One of the branched sections of the air supply tube 23 is connected to the connection member 35. The proximal end of the air supply tube 23 is connected to the connection member 25, which communicates with the air chamber 27 of the air supply device 22. As the drive mechanism 30 (the piston 26, the drum 28, and the coupler link 29) in the air supply device 22 is activated, air flows between the air chamber 27 in the cylinder 24 and the air introducing chambers 33 in the pump cases 31 through the air supply tube 23. Accordingly, the diaphragm 32 in each pump case 31 is flexed upward and downward.

An ink inlet 36 and an ink outlet 37 are formed in the bottom of the lower case 31*b* of each pump case 31. An ink inlet pipe 38 communicating with the ink inlet 36 extends from the ink inlet 36 to the outside of the pump case 31. An ink outlet pipe (liquid outlet line) 39 communicating with the ink outlet 37 extends to the outside of the pump case 31. A cylindrical connection member 40 is provided at the distal end of the ink inlet pipe 38. The distal end of the ink supply tube 21 (the downstream end in the ink supplying direction) extending from the corresponding ink cartridge 20 is connected to the connection member 40. On the other hand, the distal end of the ink outlet pipe 39 is connected to the recording head 17 located at the lower side of the carriage 14.

Further, a suction one-way valve 41 is located in the middle of the ink inlet pipe 38. The suction one-way valve 41 only permits flow of ink toward the ink introducing chamber 34 when ink flows in the ink inlet pipe 38. On the other hand, a drain one-way valve 42 is located in the middle of the ink outlet pipe 39. The drain one-way valve 42 only permits flow of ink from the ink introducing chamber 34 when ink flows in the ink outlet pipe 39. A self-sealing valve 43 is located in a section of the ink outlet pipe 39 between the drain one-way valve 42 and the recording head 17. In this embodiment, the air supply device 22, ink cartridges 20, the pumps 18, the air supply tube 23, and the ink supply tubes 21 form an ink (liquid) supply system 44.

Operation of the printer 10 according to the present embodiment, particularly, operation of the ink supply system 44, will now be described.

When supplying ink from any of the ink cartridges 20 mounted on the cartridge holder 19 to the recording head 17 mounted on the carriage 14, the drive mechanism 30 of the air supply device 22 is activated. That is, the drum 28 of the air supply device 22 is rotated from the state of FIG. 2 in a direction of the arrow (clockwise). IN the cylinder, the piston 26 repeats the cycle of moving successively along the middle position, the bottom dead center position, the middle position, the top dead center position, and the middle position in this order.

As the piston 26 moves (reciprocates), the volume of the air chamber 27 above the piston 26 changes. That is, when the piston 26 moves toward the bottom dead center, the volume of the air chamber 27 gradually increases. When the piston 26 moves toward the top dead center, the volume of the air chamber 27 gradually decreases. When the piston 26 reaches the bottom dead center position, the volume of the air chamber 27 is maximized. When the piston 26 reaches the top dead center position, the volume of the air chamber 27 is minimized.

On the other hand, in each of the pumps 18 on the carriage 14, when the volume of the air chamber 27 is increased, the air in each air introducing chamber 33 is drawn to the air chamber 27 through the air supply tube 23. That is, the air supply device 22 performs depressurization so as to draw air to the air chamber 27 from the air introducing chambers 33 through the air supply tube 23. As a result, the diaphragm 32 is flexed upward in each pump case 31.

As the diaphragm 32 flexes upward, the volume of the air introducing chamber 33 is reduced, and the volume of the ink introducing chamber 34 is increased. This lowers the pressure in the ink introducing chamber 34 (the pump internal pressure). Then, ink is drawn into the ink introducing chamber 34 through the corresponding ink supply tubes 21 and ink inlet pipe 38 from the corresponding ink cartridge 20.

Since the one-way valve 41, which is located in the ink inlet pipe 38, only permits flow of ink toward the ink introducing chamber 34, suction of ink from the ink cartridge 20 is readily performed. On the other hand, since the one-way valve 42, which is located in the ink outlet pipe 39, permits flow of ink from the ink introducing chamber 34, ink is prevented from flowing back from the recording head 17 (the self-sealing valves 43) toward the ink introducing chamber 34.

On the contrary to the case where the volume of the air chamber 27 of the air supply device 22 is increased, when the volume of the air chamber 27 is reduced, air is supplied from the air chamber 27 to the air introducing chambers 33 through the air supply tube 23. That is, the air supply device 22 performs compression so as to supply air from the air chamber 27 to the air introducing chambers 33 through the air supply tube 23. As a result, the diaphragm 32 is flexed downward in each pump case 31.

As the diaphragm 32 flexes downward, the volume of the air introducing chamber 33 is increased in the pump case 31, and the volume of the ink introducing chamber 34 is decreased. This raises the pressure in the ink introducing chamber 34 (the pump internal pressure). Then, ink is drained from the ink introducing chamber 34 to the self-sealing valve 43 through the ink outlet pipe 39. After the pressure is adjusted by the self-sealing valve 43, the ink is supplied to the recording head 17.

Since the one-way valve 42, which is located in the ink outlet pipe 39, only permits flow of ink from the ink introducing chamber 34, drain of ink from the ink introducing chamber 34 to the recording head 17 (the self-sealing valve 43) is readily performed. On the other hand, since the one-way valve 41 located in the ink inlet pipe 38 only permits flow of ink toward the ink introducing chamber 34, ink is prevented from flowing back from the ink introducing chamber 34 toward the ink cartridge 20.

Figure 3:
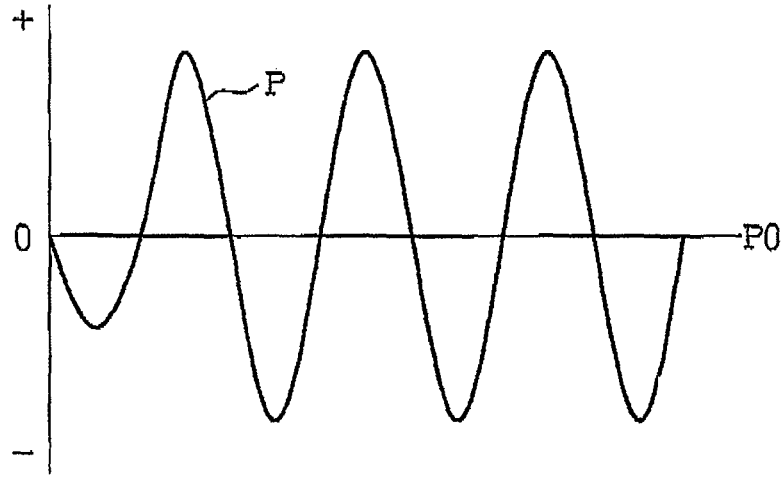
FIG. 3 is a diagram showing changes in an pump internal pressure in the liquid supply system of FIG. 2.

FIG. 3 shows changes in the pressure in one of the ink introducing chambers 34 (pump internal pressure) when the volume of the air chamber 27 is changed as the piston 26 is moved (linear reciprocation). In FIG. 3, the horizontal axis represents the atmospheric pressure P0, and the vertical axis represents the magnitude of the pressure P in the ink introducing chamber 34 (pump internal pressure). As obvious from FIG. 3, in the ink supply system 44 in this embodiment, the pump internal pressure P alternately shifts between a negative pressure state lower than the atmospheric pressure P0 and a positive pressure state higher than the atmospheric pressure P0 in accordance with the motion cycle of the piston 26.

That is, when the drum 28 in the air supply device 22 rotates from the state of FIG. 2 and the piston 26 moves from the middle position to the bottom dead center position, the pump internal pressure P is gradually decreased from the atmospheric pressure P0 and enters the negative pressure state. Then, when the piston 26 moves from the bottom dead center position toward the top dead center position, pump internal pressure P is gradually increased and enters the positive pressure state, which is higher than the atmospheric pressure P0. Then, when the piston 26 moves from the top dead center position toward the bottom dead center position, the pump internal pressure P is gradually decreased and reenters the negative pressure state, which is lower than the atmospheric pressure P0.

Referring to the sine curve of FIG. 3 representing changes in the pump internal pressure P, in a state of a downward-sloping curve, or in a depressurization period where the piston 26 is moving toward the bottom dead center, the diaphragm 32 flexes upward, so that ink is drawn from the ink cartridge 20 to the ink introducing chamber 34. On the other hand, referring to the sine curve of FIG. 3, in a state of an upward-sloping curve, or in a compression period where the piston 26 is moving toward the top dead center, the diaphragm 32 flexes downward, so that ink is drained from the ink introducing chamber 34 to the recording head 17 (the self-sealing valve 43).

As described above, pumping action is repeated in the printer 10 according to the present embodiment. That is, as the drive mechanism 30 of the air supply device 22 on the frame 11 is activated, the pumps 18 mounted on the carriage 14 draw ink from the ink cartridges 20 attached to the cartridge holder 19 of the frame 11 and send the ink to the recording head 17. When performing printing, the carriage 14, on which the recording head 17 is mounted, reciprocates along the guide member 13 by the driving force of the carriage motor 16, so that printing is performed on a recording paper sheet supplied onto the platen 12.

On the carriage 14, other than the pumps 18, each of which has the pump case 31 divided into the air introducing chamber 33 and the ink introducing chamber 34 by the diaphragm 32, only the recording head 17 and the self-sealing valves 43 are mounted. Thus, the carriage 14 is relatively light as a whole. This suppresses vibration during reciprocation and reduces electricity consumption. The air supply tubes 23, which connect the air supply device 22 on the frame 11 to the pumps 18 on the carriage 14, are used for conveying air and therefore light. This further suppresses vibration during reciprocation of the carriage 14 and reduces the electricity consumption.

The first embodiment has the following advantages.

(1) The pumps 18 performing pumping actions for supplying ink are mounted on the carriage 14, while the drive mechanism 30 for generating driving force for actuating the pumps 18 is mounted on the frame 11. Therefore, the weight of the entire carriage 14 is minimized. This suppresses vibration during the carriage 14 is reciprocated during printing, and reduces the electricity consumption required for the reciprocation.

(2) Supply of ink from each ink cartridge 20 to the ink introducing chamber 34 of the corresponding pump 18 is achieved not by pressurizing ink, but by suction of ink performed by the pumps 18. Therefore, even if minute holes are formed in the ink supply tubes 21, ink does not leak through such holes.

(3) Air is used as the working fluid for actuating the pumps 18. The air flows in the air supply tube 23 extending between the pumps 18 and the air supply device 22. Thus, compared to a case where liquid (for example, silicone oil) is used as the working fluid, the response of the operation of the pumps 18 is improved. Further, since the total weight of the air supply tube 23 for conveying air is light compared to a case where liquid is conveyed, vibration during reciprocation of the carriage 14 is suppressed, and the electricity consumption is reduced.

(4) The air supply device 22 alternately executes the pressurizing action, in which the device 22 pressurizes and supplies gas from the air chamber 27 to the pumps 18 through the air supply tube 23, and the depressurization action, in which the device depressurizes and recovers air from the pumps 18 to the air chamber 27 through the air supply tube 23. That is, since the single air supply tube 23 is used for both of pressurization and depressurization, the number of the air supply tube 23 is minimized. This reduces the costs of the printer 10.

(5) Each pump 18 has the pump case 31, the interior of which is divided into the air introducing chamber 33 and the ink introducing chamber 34 by the diaphragm 32. In the ink inlet pipe 38 and ink outlet pipe 39 communicating with the ink intruding chamber 34, the one-way valves 41, 42 are provided, respectively. Thus, the pump 18 has a simple structure and is light. Therefore, since the pumps 18 are simplified, the costs of the printer 10 are reduced. Also, since the weight load on the carriage 14, which reciprocates while mounting the pumps 18, is reduced, the vibration during reciprocation is suppressed and the electricity consumption is reduced.

(6) The distal end of the air supply tube 23, which corresponds to the pumps 18, is branched. That is, the single air supply tube 23 is used to connect the air supply device 22 on the frame 11 to the multiple (four) pumps 18 on the carriage 14. Thus, the single air supply tube 23 and the single air supply device 22 are shared by the pumps 18. This further reduces the costs of the printer 10.

Next, a second embodiment of the present invention will be described with reference to FIGS. 4 and 5.

In the second embodiment, the configuration of a part of an ink supply system 44 is different from that of the first embodiment. Accordingly, differences from the first embodiment will mainly be discussed below, and like or the same reference numerals are given to those components that are like or the same as the corresponding components of the first embodiment.

Figure 4:
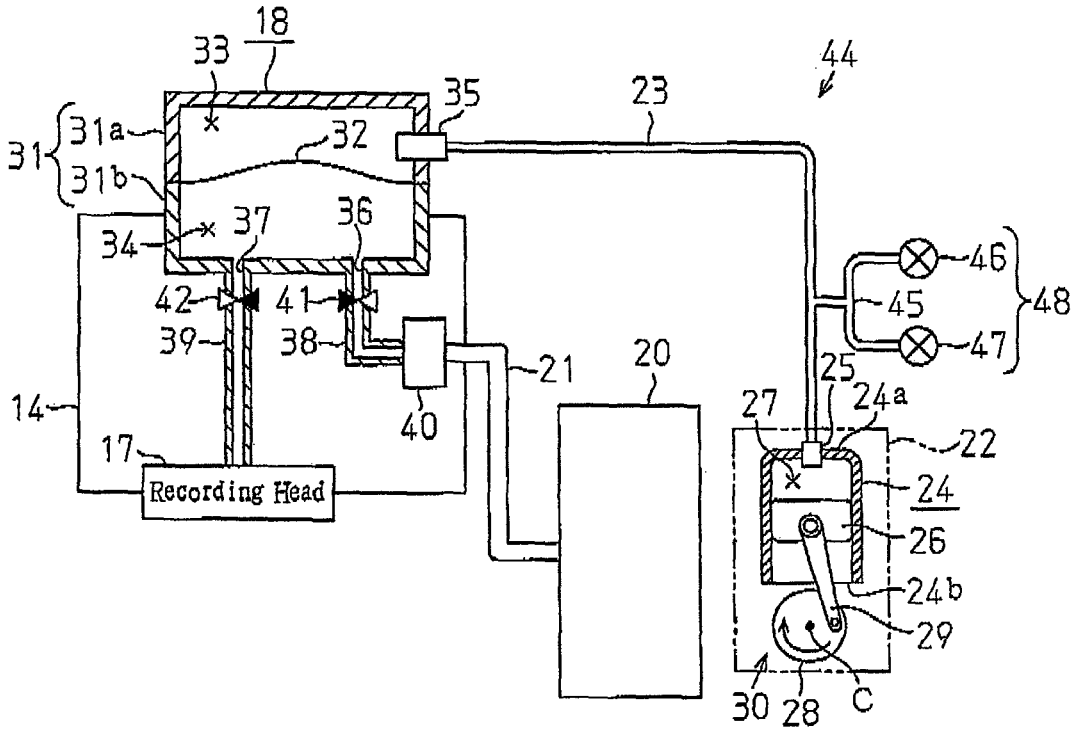
FIG. 4 is a diagrammatic view illustrating a liquid supply system in a printer according to a second embodiment of the present invention.
Figure 5:
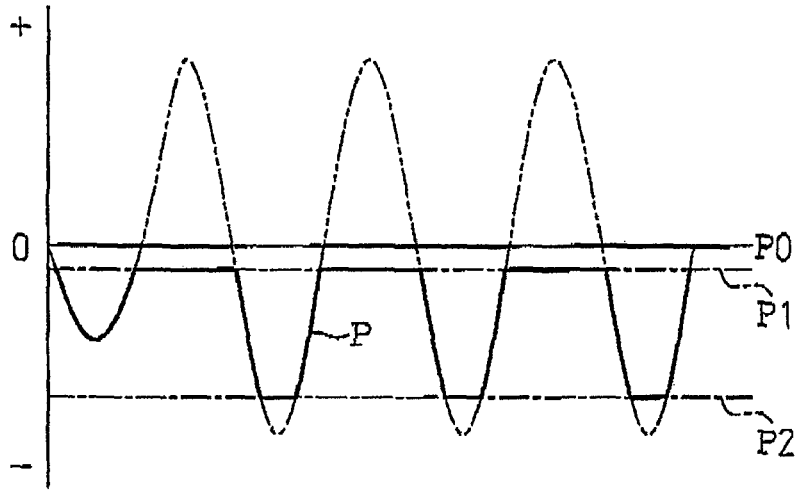
FIG. 5 is a diagram showing changes in an pump internal pressure in the liquid supply system of FIG. 4.

As shown in FIG. 4, a branch pipe 45 is connected to the air supply tube 23 in the ink supply system 44 of the present embodiment. The branch pipe 45 has bifurcated ends. A pressurization relief valve 46 is provided at one of the bifurcated ends, and a depressurization relief valve 47 is provided at the other end. The pressurization relief valve 46 and the depressurization relief valve 47, when opened, function to cause the interior of the air supply tube 23 to communicate with the outside. The conditions in which the relief valves 46, 47 are as follows.

That is, the pressurization relief valve 46 is configured to open when the pressure of the air in the air supply tube 23 is equal to or greater than a predetermined pressurization upper limit value P1 (see FIG. 5) that is slightly lower than the atmospheric pressure P0. On the other hand, the depressurization relief valve 47 is configured to open when the pressure of the air in the air supply tube 23 is equal to or lower than a predetermined depressurization lower limit value P2 (see FIG. 5) that is lower than the pressurization upper limit value P1. In this embodiment, the pressurization relief valve 46 and the depressurization relief valve 47 form a pressure adjustment mechanism 48. Unlike the first embodiment, the ink supply system 44 of the present invention has no self-sealing valve 43 on the carriage 14.

Operation of the printer 10 according to the second embodiment, particularly, operation of the ink supply system 44, will now be described. Differences from the first embodiment will be mainly discussed.

When supplying ink from any of the ink cartridges 20 to the recording head 17 in the printer 10 according to the second embodiment, the drive mechanism 30 of the air supply device 22 is activated. As in the case of the first embodiment, the piston 26 repeats motion cycle in the cylinder 24, in which the piston 26 reciprocates between the top dead center position and the bottom dead center position.

In correspondence with the motion cycle of the piston 26, the air supply device 22 on the frame 11 alternately performs pressurization for pressurizing and supplying air from the air chamber 27 to the pumps 18 on the carriage 14, and depressurization for depressurizing and recovering air from the pumps 18 to the air chamber 27. Since the pressure adjustment mechanism 48 formed by the pressurization relief valve 46 and the depressurization relief valve 47 is located in the air supply tube 23, the operation of the second embodiment is different from that of the first embodiment in the following points.

That is, during the pressurization period in which the piston 26 moves from the bottom dead center position toward the top dead center position, if the pressure of air flowing in the air supply tube 23 from the air chamber 27 toward the air introducing chamber 33 is equal to or greater than the pressurization upper limit value P1, the pressurization relief valve 46 is opened. As the pressurization relief valve 46 opens, the inside of the air supply tube 23 communicates with the outside, so that air is released to the outside from the air supply tube 23 in the pressurized state.

Therefore, pressurized air the pressure of which is less than the pressurization upper limit value P1 (P1<atmospheric pressure P0) is sent to the air introducing chamber 33. Based on the pressurizing force of the pressurized air, the diaphragm 32 flexes downward so that the volume of the ink introducing chamber 34 is reduced. Since the pressure in the ink introducing chamber 34 (pump internal pressure P) corresponds to the pressure of the pressurized air that flexes the diaphragm 32, the pressure in the ink introducing chamber 34 does not exceed the pressurization upper limit value P1.

On the other hand, during the depressurization period in which the piston 26 moves from the top dead center position toward the bottom dead center position, if the pressure of air flowing in the air supply tube 23 from the air introducing chamber 33 to the air chamber 27 is equal to or less than the depressurization lower limit value P2, the depressurization relief valve 47 is opened. As the depressurization relief valve 47 opens, the inside of the air supply tube 23 communicates with the outside, so that air flows into the air supply tube 23 in the depressurized state from the outside.

Therefore, the pressure of the depressurized air recovered from the air introducing chamber 33 is higher than the depressurization lower limit value P2 (P2<pressurization upper limit value P1<atmospheric pressure P0). Therefore, as shown in FIG. 5, the pressure in the ink introducing chamber 34 (the pump internal pressure P), the volume of which is increased by the diaphragm 32 flexing upward, does not fall below the depressurization lower limit value P2.

In the second embodiment, the pumps 18 are actuated based on the supply of pressurized air and the recovery of depressurized air, in which the pressure of the air changes between the pressurization upper limit value P1 lower than the atmospheric pressure P0 and the depressurization lower limit value P2 that is lower than the pressurization upper limit value P1. Ink is supplied from the ink introducing chambers 34 to the recording head 17 by the pump internal pressure P, which changes between the pressurization upper limit value P1 and the depressurization lower limit value P2.

In addition to the items (1) through (6) of the advantages of the first embodiment, the second embodiment provides the following advantages.

(7) The pressure adjustment mechanism 48 is located in the air supply tube 23. The pressurization relief valve 46 of the pressure adjustment mechanism 48 opens when the pressure of the air in the air supply tube 23 is equal to or greater than the pressurization upper limit value P1, which is slightly lower than the atmospheric pressure P0, so that the inside and the outside of the air supply tube 23 communicate with each other. Therefore, even if a minute hole is formed in the air supply tube 23, air (working fluid) does not leak from the air supply tube 23 through the formed hole to the outside, the pressure of which is the atmospheric pressure P0.

(8) Further, the pump internal pressure P, which corresponds to the pressure of the air in the air supply tube 23, does not become excessively higher than the atmospheric pressure P0. Thus, without providing the self-sealing valve 43, ink is prevented from being supplied to the recording head 17 at a high pressure. Since the self-sealing valve 43 is not needed, the total weight of the carriage 14 is reduced, and the costs of the printer 10 are also reduced.

(9) During the depressurization period in which air flows from the air introducing chamber 33 to the air chamber 27 through the air supply tube 23, when the pressure of the flowing air is equal to or less than the depressurization lower limit value P2, the depressurization relief valve 47 of the pressure adjustment mechanism 48 is opened, so that the inside and the outside of the air supply tube 23 communicate with each other. Thus, when it is shifted from the depressurization to pressurization, the response of the pumps 18 (the diaphragms 32) is reliably prevented from delayed.

Next, a third embodiment of the present invention will be described with reference to FIGS. 6 and 7.

In the third embodiment also, the configuration of a part of an ink supply system 44 is different from that of the first embodiment. Accordingly, differences from the first embodiment will mainly be discussed below, and like or the same reference numerals are given to those components that are like or the same as the corresponding components of the first embodiment.

Figure 6:
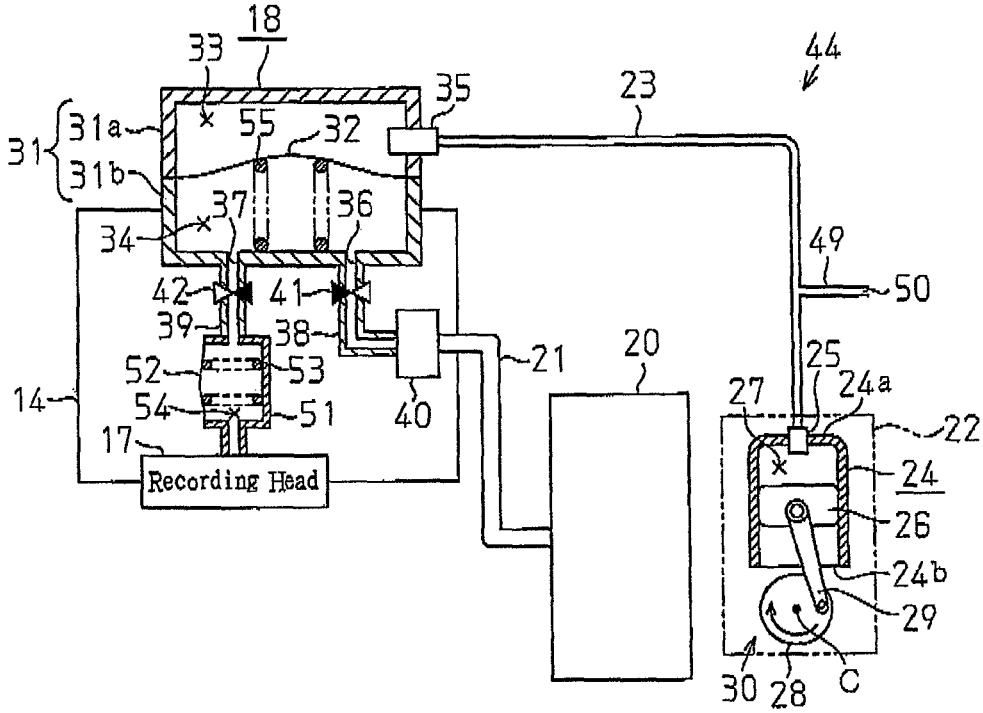
FIG. 6 is a diagrammatic view illustrating a liquid supply system in a printer according to a third embodiment of the present invention.

As shown in FIG. 6, a narrow tube 49 is connected to the air supply tube 23 in the ink supply system 44 of the present embodiment. A pore 50 is formed in the distal end of the narrow tube 49. That is, the narrow tube 49 causes the inside and the outside of the air supply tube 23 with each other through the pore 50 formed at the distal end. The inner diameter of the narrow tube 49 having the pore 50 is significantly less than the inner diameter of the air supply tube 23. Thus, the dynamic pressure required for air to pass the narrow tube 49 is increased. Air therefore hardly leaks to the outside from the air supply tube 23 through the pore 50.

On the other hand, a box-like ink reservoir case 51 is provided in each ink outlet pipe 39, which extends between the corresponding ink introducing chamber 34 and the recording head 17. The ink reservoir case 51 is located closer to the recording head 17 than to the drain one-way valve 42. The ink reservoir case 51 has an opening at one side. The opening is covered with a plastic film 52. A spring 53 is located in the ink reservoir case 51 to urge the film 52 toward the outside with a predetermined urging force F1 (see FIG. 7). The ink reservoir case 51 has an ink reservoir chamber 54 in it. Ink drained from the ink introducing chamber 34 is supplied to the recording head 17 via the ink reservoir chamber 54.

Figure 7:
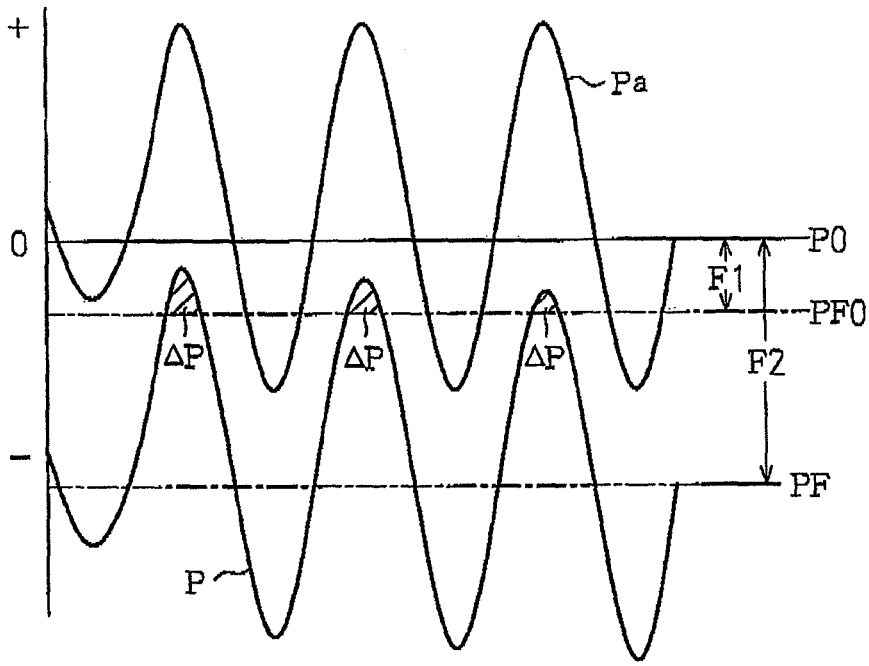
FIG. 7 is a diagram showing changes in an pump internal pressure in the liquid supply system of FIG. 6.

A spring (urging member) 55 is located in the ink introducing chamber 34 to urge the diaphragm 32 toward the air introducing chamber 33 by a predetermined urging force F2 (see FIG. 7). The urging force F2 of the spring 55 is greater than the urging force F1 of the spring 53 in the ink reservoir chamber 54. In a case where the spring 55 is not provided, the pump internal pressure changes with the atmospheric pressure P0 as a central pressure value (see an upper sine curve Pa in FIG. 7). In the case where the spring 55 is provided, the central pressure value PF of the fluctuation of the pump internal pressure is lowered compared to the atmospheric pressure P0 by the amount corresponding to the urging force F2 of the spring 55 (see a lower sine curve P in FIG. 7). As in the second embodiment, the carriage 14 is not provided with the self-sealing valve 43 in this embodiment.

Operation of the printer 10 according to the third embodiment, particularly, operation of the ink supply system 44, will now be described. Differences from the first embodiment will be mainly discussed.

When supplying ink from any of the ink cartridges 20 to the recording head 17 in the printer 10 according to the third embodiment, the drive mechanism 30 of the air supply device 22 is activated. As in the case of the first and second embodiments, the piston 26 repeats motion cycle in the cylinder 24, in which the piston 26 reciprocates between the top dead center position and the bottom dead center position.

In correspondence with the motion cycle of the piston 26, the air supply device 22 on the frame 11 alternately performs pressurization for pressurizing and supplying air from the air chamber 27 to the pumps 18 on the carriage 14, and depressurization for depressurizing and recovering air from the pumps 18 to the air chamber 27. Since the narrow tube 49 is provided in the air supply tube and the springs 53 and 55 are provided in the ink reservoir chamber 54 and the ink introducing chamber 34, respectively, in the third embodiment, the operation of the second embodiment is different from that of the first embodiment in the following points.

That is, if the spring 55 is not provided in the ink introducing chamber 34, the pump internal pressure in each pump 18 periodically fluctuates about a central pressure value, which is, in this case, the atmospheric pressure P0 as indicated by the upper sine curve Pa in FIG. 7 as in the case of the first embodiment. However, in this embodiment, the pump internal pressure periodically fluctuates about a central pressure value PF as represented by the lower sine curve P in FIG. 7. The central pressure value PF is lower than the atmospheric pressure P0 by the amount corresponding to the urging force F2 of the spring 55.

Also, when the ambient temperature of the surroundings in which the printer 10 is installed changes, for example, when the ambient temperature increases, the pressure of the air in the air supply tube 23 (the pressure corresponding to the pump internal pressure) has been slightly increased in some cases before the drive mechanism 30 of the air supply device 22 is activated. FIG. 7 shows the state of changes in the pump internal pressure P (Pa) in such a case. That is, the pump internal pressure P is slightly higher than the central pressure value PF prior to the movement of the piston 26 from the middle position toward the bottom dead center position caused by the activation of the air supply device 22. From this pressure state, the pump internal pressure P starts periodically fluctuating in accordance with the linear reciprocation of the piston 26.

In this embodiment, the pore 50 causes the inside of the air supply tube 23 to communicate with the outside, which is under the atmospheric pressure P0. Therefore, every time the pressurization and depressurization of the air supply device 22 are repeated, air is gradually but steadily discharged to the outside from the air supply tube 23 through the pore 50. Then, the pump internal pressure P gradually decreases (see FIG. 7) to cancel the above described initial increase (initial displacement relative to the central pressure value PF). Specifically, the pump internal pressure P is gradually lowered until it periodically fluctuates about the central pressure value PF.

By the above described action of the pumps 18, ink drawn into ink introducing chambers 34 from the ink cartridges 20 is supplied to the recording head 17. At this time, the ink is temporarily stored in the ink reservoir chambers 54 after passing through the drain one-way valves 42.

That is, since the urging force F1 of the spring 53 flexes the film 52 outward, the pressure in the ink reservoir chamber 54 is in the negative pressure state corresponding to the urging force F1. Therefore, in the state where ink flows from the ink introducing chamber 34 to the ink reservoir chamber 54 at the pump internal pressure P higher than the negative pressure (F1) in the ink reservoir chamber 54, ink the amount of which corresponds to the amount of ink that flows into the ink reservoir chamber 54 is drained (supplied) to the recording head from the ink reservoir chamber 54.

As shown in FIG. 7, the pump internal pressure P periodically exceeds a pressure value PF0 that is lower than the atmospheric pressure P0 by the amount corresponding to the urging force F1 of the spring 53. When above the pressure value PF0, the pump internal pressure P is in a pressure fluctuation range ΔP. Ink is supplied to the recording head 17 when the pump internal pressure P is in the pressure fluctuation range ΔP. That is, the pressure fluctuation range ΔP represents the performance of the pumps 18.

In addition to the items (1) through (6) of the advantages of the first embodiment, the third embodiment provides the following advantages.

(10) Since air is discharged from the pore 50 of the narrow tube 49 provided in the air supply tube 23, pressure fluctuation in the pump internal pressure P has a symmetric waveform with respect to the predetermined central pressure value PF. Therefore, the drive mechanism 30 of the air supply device 22 does not require a valve structure. Accordingly, inexpensive and reliable liquid ejection is realized.

(11) The urging force F2 of the spring 55 in the ink introducing chamber 34 urges the diaphragm 32 toward the air introducing chamber 33. This lowers the pump internal pressure P, or the pressure in the ink introducing chamber 34, by the amount corresponding to the urging force F2. Therefore, the pressure of air supplied from the air supply device 22 to the pumps 18 does not need to be significantly increased, and liquid ejection is reliably realized with a low electricity consumption.

(12) The urging force F2 of the spring 55 causes the pump internal pressure P to fluctuate in a pressure range lower than the atmospheric pressure P0. Therefore, as in item (7) of the advantages of the second embodiment, even if a minute hole is formed in the air supply tube 23, air (working fluid) does not leak through the formed hole from the air supply tube 23 to the outside, the pressure of which is the atmospheric pressure P0.

Next, a fourth embodiment of the present invention will be described with reference to FIGS. 8 and 9.

In the fourth embodiment also, the configuration of a part of an ink supply system 44 is different from that of the first embodiment. Accordingly, differences from the first embodiment will mainly be discussed below, and like or the same reference numerals are given to those components that are like or the same as the corresponding components of the first embodiment.

Figure 8:
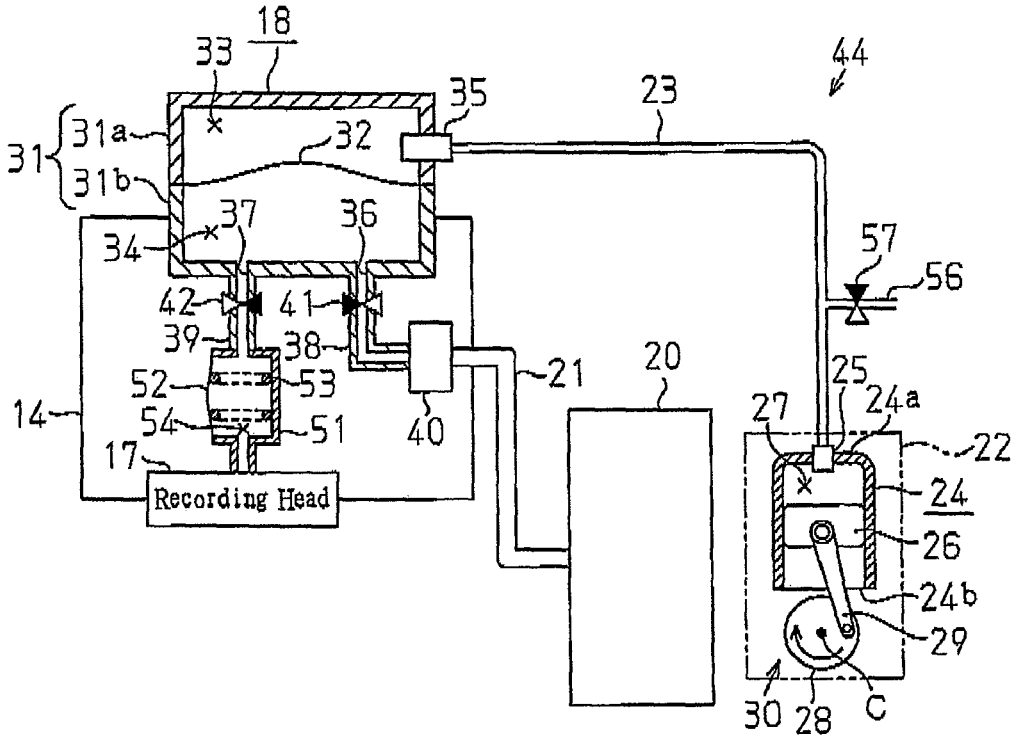
FIG. 8 is a diagrammatic view illustrating a liquid supply system in a printer according to a fourth embodiment of the present invention.
Figure 9:
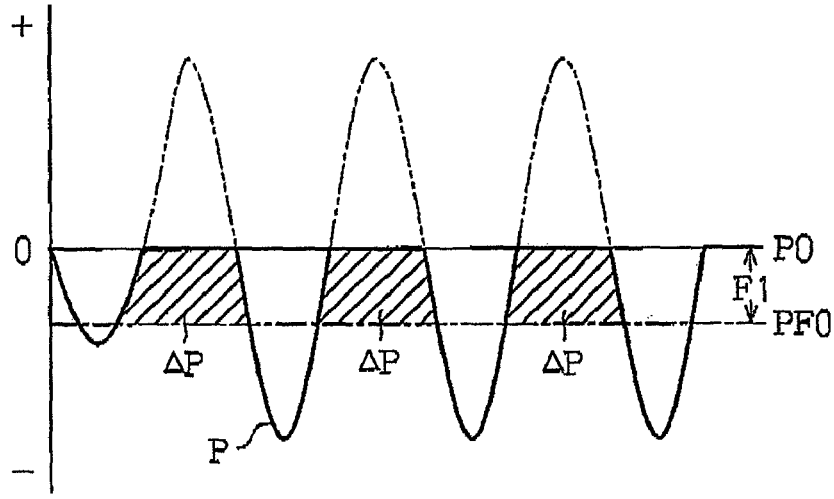
FIG. 9 is a diagram showing changes in an pump internal pressure in the liquid supply system of FIG. 8.

As shown in FIG. 8, an air release pipe 56 is connected to the air supply tube 23 in the ink supply system 44 of the present embodiment. A check valve 57 serving as a pressure adjusting valve is located in the air release pipe 56. The check valve 57 opens when the pressure of the air in the air supply tube 23 is equal to or greater than the atmospheric pressure P0. That is, it is configured, when the air supply device 22 repeats pressurization and depressurization, air flows in the air supply tube 23 according to pressure fluctuation in a range lower than the atmospheric pressure P0.

On the other hand, as in the third embodiment, a box-like ink reservoir case 51 is provided in each ink outlet pipe 39, which extends between the corresponding ink introducing chamber 34 and the recording head 17. The ink reservoir case 51 is located closer to the recording head 17 than to the drain one-way valve 42. An opening of the ink reservoir case 51 is covered with a plastic film 52. A spring 53 is located in the ink reservoir case 51 to urge the film 52 toward the outside with a predetermined urging force F1 (see FIG. 9). Ink drained from the ink introducing chamber 34 is supplied to the recording head 17 via an ink reservoir chamber 54 in the ink reservoir case 51. As in the second and third embodiments, the carriage 14 is not provided with the self-sealing valve 43 in this embodiment.

Operation of the printer 10 according to the fourth embodiment, particularly, operation of the ink supply system 44, will now be described. Differences from the first embodiment will be mainly discussed.

When supplying ink from any of the ink cartridges 20 to the recording head 17 in the printer 10 according to the fourth embodiment, the drive mechanism 30 of the air supply device 22 is activated. As in the case of the first to third embodiments, the piston 26 repeats motion cycle in the cylinder 24, in which the piston 26 reciprocates between the top dead center position and the bottom dead center position.

In correspondence with the motion cycle of the piston 26, the air supply device 22 on the frame 11 alternately performs pressurization for pressurizing and supplying air from the air chamber 27 to the pumps 18 on the carriage 14, and depressurization for depressurizing and recovering air from the pumps 18 to the air chamber 27. Since the check valve 57 is located in the air release pipe 56 that branches off the air supply tube 23, the operation of the fourth embodiment is different from that of the first embodiment in the following points.

That is, when the air supply device 22 repeats pressurization and depressurization so that air flows in the air supply tube 23, if the pressure of the flowing air is equal to or higher than the atmospheric pressure P0, the check valve 57 opens and releases the high pressure air to the outside. Therefore, the pump internal pressure P, which corresponds to the pressure of the air in the air supply tube 23, does not become equal to or higher than the atmospheric pressure P0, and periodically fluctuates in a pressure range lower than the atmospheric pressure P0 as shown in FIG. 9.

Ink drained to the recording head 17 from each ink introducing chamber 34 is temporarily stored in the corresponding ink reservoir chamber 54. The pump internal pressure P periodically exceeds the pressure value PF0 that is lower than the atmospheric pressure P0 by the amount corresponding to the urging force F1 of the spring 53. When above the pressure value PF0, the pump internal pressure P is in the pressure fluctuation range ΔP, and ink is supplied to the recording head 17.

In addition to the items (1) through (6) of the advantages of the first embodiment, the fourth embodiment provides the following advantages.

(13) When the pressure of the air in the air supply tube 23 is equal to or higher than the atmospheric pressure P0, the check valve 57 opens and releases air to the outside, so that the pump internal pressure P fluctuates in a pressure range lower than the atmospheric pressure P0. Therefore, as in item (7) of the advantages of the second embodiment and the item (12) of the advantages of the third embodiment, even if a minute hole is formed in the air supply tube 23, air (working fluid) does not leak from the air supply tube 23 through the formed hole to the outside, the pressure of which is the atmospheric pressure P0.

Next, a fifth embodiment of the present invention will be described with reference to FIGS. 10 and 11.

In the fifth embodiment also, the configuration of a part of an ink supply system 44 is different from that of the first embodiment. Accordingly, differences from the first embodiment will mainly be discussed below, and like or the same reference numerals are given to those components that are like or the same as the corresponding components of the first embodiment.

Figure 10:
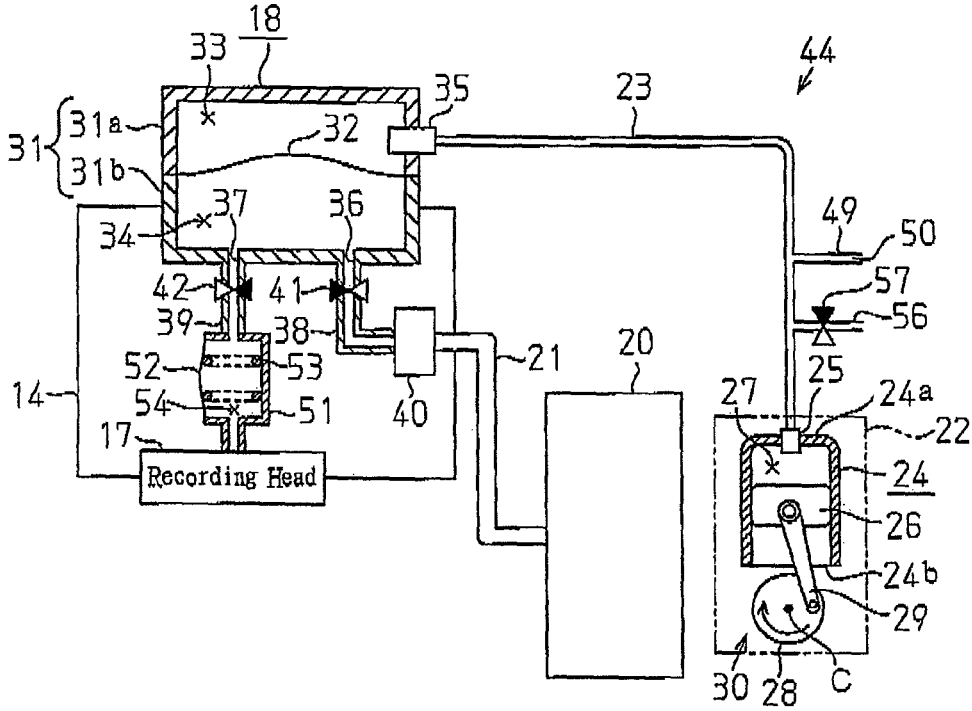
FIG. 10 is a diagrammatic view illustrating a liquid supply system in a printer according to a fifth embodiment of the present invention.
Figure 11:
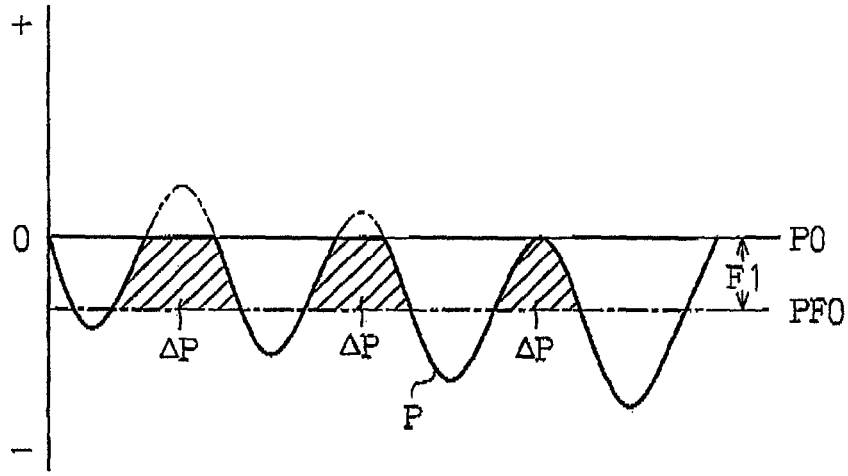
FIG. 11 is a diagram showing changes in a pump internal pressure in the liquid supply system of FIG. 10.

As shown in FIG. 10, the ink supply system 44 of this embodiment has a configuration in which the narrow tube 49 having the pore 50 shown in FIG. 6 is combined with the ink supply system 44 of the fourth embodiment shown in FIG. 8. That is, the narrow tube 49 having the pore 50 at the distal and the check valve 57 are provided in the air supply tube 23.

As in the fourth embodiment, a box-like ink reservoir case 51 is provided in each ink outlet pipe 39, which extends between the corresponding ink introducing chamber 34 and the recording head 17. The ink reservoir case 51 is located closer to the recording head 17 than to the drain one-way valve 42. An opening of the ink reservoir case 51 is covered with a plastic film 52. A spring 53 is located in the ink reservoir case 51 to urge the film 52 toward the outside with a predetermined urging force F1 (see FIG. 11). Ink drained from the ink introducing chamber 34 is supplied to the recording head 17 via an ink reservoir chamber 54 in the ink reservoir case 51. As in the second to fourth embodiments, the carriage 14 is not provided with the self-sealing valve 43 in this embodiment.

Operation of the printer 10 according to the fifth embodiment, particularly, operation of the ink supply system 44, will now be described. Differences from the first embodiment will be mainly discussed.

When supplying ink from any of the ink cartridges 20 to the recording head 17 in the printer 10 according to the fifth embodiment, the drive mechanism 30 of the air supply device 22 is activated. As in the case of the first to fourth embodiments, the piston 26 repeats motion cycle in the cylinder 24, in which the piston 26 reciprocates between the top dead center position and the bottom dead center position.

In correspondence with the motion cycle of the piston 26, the air supply device 22 on the frame 11 alternately performs pressurization for pressurizing and supplying air from the air chamber 27 to the pumps 18 on the carriage 14, and depressurization for depressurizing and recovering air from the pumps 18 to the air chamber 27. Since the narrow tube 49 having the pore 50 and the air release pipe 56 having the check valve 57 branch off the air supply tube 23, the operation of the fifth embodiment is different from that of the first embodiment in the following points.

That is, when the air supply device 22 repeats pressurization and depressurization so that air flows in the air supply tube 23, if the pressure of the flowing air is equal to or higher than the atmospheric pressure P0, the check valve 57 opens and releases the high pressure air to the outside. Therefore, the pump internal pressure P, which corresponds to the pressure of the air in the air supply tube 23, does not become equal to or higher than the atmospheric pressure P0, and periodically fluctuates in a pressure range lower than the atmospheric pressure P0 as shown in FIG. 11.

Ink drained to the recording head 17 from each ink introducing chamber 34 is temporarily stored in the corresponding ink reservoir chamber 54. The pump internal pressure P periodically exceeds the pressure value PF0 that is lower than the atmospheric pressure P0 by the amount corresponding to the urging force F1 of the spring 53. When above the pressure value PF0, the pump internal pressure P is in the pressure fluctuation range ΔP, and ink is supplied to the recording head 17.

Also, when the ambient temperature of the surroundings in which the printer 10 is installed is low, the pressure of the air in the air supply tube 23 (the pressure corresponding to the pump internal pressure) has been shifted to a negative pressure. Such a state is canceled by flow of air through the pore 50. That is, every time the pressurization and depressurization of the air supply device 22 are repeated, air is gradually but steadily drawn into the air supply tube 23 from the outside through the pore 50. As air is drawn, the pump internal pressure P gradually increases until the maximum pressure substantially becomes the atmospheric pressure.

In addition to the items (1) through (6) of the advantages of the first embodiment, the fifth embodiment provides the following advantages.

(14) When the pressure of the air in the air supply tube 23 is equal to or higher than the atmospheric pressure P0, the check valve 57 opens and releases air to the outside, so that the pump internal pressure P fluctuates in a pressure range lower than the atmospheric pressure P0. Therefore, as in item (7) of the advantages of the second embodiment, the item (12) of the advantages of the third embodiment, and the item (13) of the advantages of the fourth embodiment, even if a minute hole is formed in the air supply tube 23, air (working fluid) does not leak from the air supply tube 23 through the formed hole to the outside, the pressure of which is the atmospheric pressure P0.

(15) Since air is discharged from the pore 50 of the narrow tube 49 provided in the air supply tube 23, pressure fluctuation in the pump internal pressure P has a waveform the maximum pressure of which is approximately equal to the atmospheric pressure. Therefore, the drive mechanism 30 of the air supply device 22 does not require a valve structure. Accordingly, inexpensive and reliable liquid ejection is realized.

The embodiments illustrated above may be modified as the following embodiments.

Figure 12:
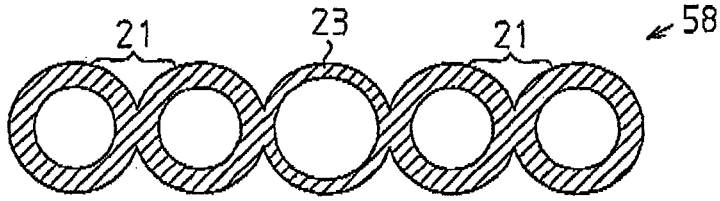
FIG. 12 is a cross-sectional view illustrating a flat tube having integrated tube parts according to a modified embodiment of the present invention.

As shown in FIG. 12, the ink supply tubes 21 and the air supply tube 23 may be formed integrally. That is, a belt-like flat tube 58, which formed by integrating the ink supply tubes 21 and the air supply tube 23, may be used. In this case, a section in which air flows, or the section corresponding to the air supply tube 23, may be formed to have thinner wall than the ink supply tubes 21 in which ink flows.

A plurality of air supply devices 22 the number of which is the same as the number of the pumps 18 mounted on the carriage 14 may be mounted on the frame 11, and each pair of one of the air supply devices 22 and the corresponding pump 18 may be connected with one of separate air supply tubes 23. The number of the pumps 18 does not need to be the same as the number of the air supply devices 22. In this case, the connecting structure may be changed as necessary. For example, one of the air supply devices 22 may correspond to two or three of the pumps 18.

In the ink supply system 44 of the fifth embodiment shown in FIG. 10, a spring 55 having the urging force F2 may be provided in each ink introducing chamber 34.

In the ink supply system 44 of the third embodiment shown in FIG. 6, the spring 55 having the urging force F2 may be omitted from each ink introducing chamber 34.

The air supply device 22 may be configured as a bellows pump, which has an air chamber in it and, and expands and contracts. In this case, if the pressurizing force for pressurization and the depressurizing force for depressurization are set in advance, the pore 50 illustrated in the third embodiment shown in FIG. 6 or the fifth embodiment shown in FIG. 10 may be omitted.

The check valve 57 may be omitted in the fourth embodiment shown in FIG. 8 or the fifth embodiment shown in FIG. 10.

In the illustrated embodiments, air is used as the working fluid. However, liquid such as silicone oil may be used as the working fluid.

The invention claimed is:

1. A liquid ejection apparatus comprising:

an apparatus main body;

a liquid ejection head for ejecting a liquid;

a pump for supplying the liquid to the liquid ejection head;

a working fluid supply source provided in the apparatus main body, the working fluid supply source having a drive mechanism;

a liquid supply source containing the liquid;

a working fluid supply line connecting the pump to the working fluid supply source, wherein, in response to actuation of the drive mechanism, the working fluid is supplied to the pump from the working fluid supply source through the working fluid supply line;

a liquid supply line connecting the pump to the liquid supply source;

a liquid outlet line connecting the pump to the liquid ejection head, wherein, in response to a change in a pressure of the working fluid, the pump draws the liquid from the liquid supply source through the liquid supply line, and is pressurized by the drive mechanism and supplies the liquid to the liquid ejection head through the liquid outlet line;

a first one-way valve provided in the liquid supply line to only permit a flow of the liquid from the liquid supply source to the pump; and a second one-way valve provided in the liquid outlet line to only permit a flow of the liquid from the pump to the liquid ejection head.

2. The liquid ejection apparatus according to claim 1, wherein the working fluid supply source has a fluid chamber communicating with the working fluid supply line, and wherein, as a volume of the fluid chamber changes in response to actuation of the drive mechanism, the working fluid supply source performs depressurization for depressurizing and recovering the working fluid from the pump to the fluid chamber.

3. The liquid ejection apparatus according to claim 1, wherein, in response to actuation of the drive mechanism, the working fluid supply source alternately performs pressurization for pressurizing and supplying the working fluid to the pump, and depressurization for depressurizing and recovering the working fluid from the pump.

4. The liquid ejection apparatus according to claim 3, wherein a pressure adjustment mechanism is provided in the working fluid supply line, wherein, among an upper limit value of the pressure of the working fluid during the pressurization performed by the working fluid supply source and a lower limit value of the pressure of the working fluid during the depressurization performed by the working fluid supply source, the pressure adjustment mechanism at least sets the upper limit value.

5. The liquid ejection apparatus according to claim 4, wherein the pressure adjustment mechanism includes a pressure adjusting valve, wherein, when the pressure of the working fluid in the working fluid supply line becomes a predetermined pressure, the pressure adjusting valve opens so that the inside of the working fluid supply line communicates with the outside.

6. The liquid ejection apparatus according to claim 1, wherein a pore is formed in the working fluid supply line, the pore causing the inside of the working fluid supply line to communicate with the outside.

7. The liquid ejection apparatus according to claim 1, wherein the pump includes a working fluid intruding chamber and a liquid introducing chamber that are separated by a diaphragm, wherein the working fluid supply line is connected to the working fluid introducing chamber, and the liquid supply line and the liquid outlet line are connected to the liquid introducing chamber.

8. The liquid ejection apparatus according to claim 7, wherein the pump includes an urging member that urges the diaphragm from the liquid introducing chamber toward the working fluid introducing chamber.

9. The liquid ejection apparatus according to claim 1, wherein the pump is one of a plurality of pumps, wherein the liquid supply source is one of a plurality of liquid supply source the number of which is the same as the number of the pumps, wherein the liquid supply line is one of a plurality of liquid supply lines, the each liquid supply line individually connecting one of the pumps to corresponding one of the liquid supply sources, and wherein the working fluid supply source is commonly connected to the pumps.

10. The liquid ejection apparatus according to claim 1, wherein the working fluid supply line and the liquid supply line are formed integrally.

11. A method for ejecting a liquid in a liquid ejection apparatus, the apparatus including a liquid ejection head for ejecting the liquid, a pump for supplying the liquid to the liquid ejection head, and a liquid supply source containing the liquid, the method comprising:

providing an apparatus main body with a working fluid supply source having a drive mechanism;

supplying working fluid from the working fluid supply source to the pump through a working fluid supply line in response to an actuation of the drive mechanism;

causing the pump to perform pumping action in response to a change in a pressure of the working fluid, thereby drawing the liquid from the liquid supply source to the pump through a liquid supply line and pressurizing by the drive mechanism and supplying the liquid from the pump to the liquid ejection head through a liquid outlet line;

providing a first one-way valve in the liquid supply line to only permit a flow of the liquid from the liquid supply source to the pump; and providing a second one-way valve in the liquid outlet line to only permit a flow of the liquid from the pump to the liquid ejection head.

12. The liquid ejection apparatus according to claim 1, further comprising a pressure adjusting portion provided in a section of the liquid outlet line between the second one-way valve and the liquid ejection head to adjust the pressure of the liquid supplied from the pump to the liquid ejection head.

13. A liquid ejection apparatus comprising:

an apparatus main body;

a liquid ejection head for ejecting liquid;

a pump for supplying liquid to the liquid ejection head;

a working fluid supply source provided in the apparatus main body, the working fluid supply source having a drive mechanism;

a liquid supply source containing liquid;

a working fluid supply line connecting the pump to the working fluid supply source, wherein, in response to actuation of the drive mechanism, the working fluid is supplied to the pump from the working fluid supply source through the working fluid supply line; and a liquid supply line connecting the pump to the liquid supply source, wherein, in response to a change in a pressure of the working fluid, the pump draws liquid from the liquid supply source through the liquid supply line, and pressurizes and supplies the liquid to the liquid ejection head, wherein the working fluid supply source has a fluid chamber communicating with the working fluid supply line, and wherein, as a volume of the fluid chamber changes in response to actuation of the drive mechanism, the working fluid supply source performs depressurization for depressurizing and recovering the working fluid from the pump to the fluid chamber.

* * * * *